United States Patent [19]

Phillips

[11] 3,943,521

[45] Mar. 9, 1976

[54] CORRUGATED MICROWAVE HORN

[75] Inventor: James P. Phillips, Lockport, Ill.

[73] Assignee: Andrew Corporation, Orland Park, Ill.

[22] Filed: June 11, 1975

[21] Appl. No.: 585,974

Related U.S. Application Data

[62] Division of Ser. No. 506,168, Sept. 16, 1974, Pat. No. 3,914,861.

[52] U.S. Cl. ..... 343/786

[51] Int. Cl.[2] ..... H01Q 13/02

[58] Field of Search ..... 343/781, 786, 908

[56] References Cited

OTHER PUBLICATIONS

Davis: Corrugations Improve Monopulse Feed Horns, Microwaves, Apr. 1972, pp. 58, 60, 61, 63.

*Primary Examiner*—Eli Lieberman

*Attorney, Agent, or Firm*—Wolfe, Hubbard, Leydig, Voit & Osann, Ltd.

[57] ABSTRACT

A corrugated microwave horn or the like is constructed by forming a plurality of thin, parallel, annular plates of conductive metal with a multiplicity of integral tabs spaced around the periphery of each plate. A thin flat sheet of flexible conductive metal is formed with a multiplicity of spaced parallel slots arranged in a multiplicity of longitudinal columns and transverse rows. One of the tabs on each of the annular plates is fitted through the slots in one of the longitudinal columns, and a wire is inserted through apertures in the tabs to lock the slotted sheet to the annular plates. The slotted sheet is then rolled around the peripheries of the plates to fit successive tabs through the successive longitudinal columns of slots, and additional wires are inserted through the apertures in successive tabs to lock the sheet to successive portions of the peripheries of the plates. To provide a continuous electrical connection between the rolled sheet and the peripheries of the annular plates, the entire assembly may be soldered together by simply coating the outer surface of the assembly with a paste solder and then heating it. The tabs may be formed on the inner peripheries rather than the outer peripheries of the plate members, and the slotted sheet formed of resilient metal so that it is biased against the inner peripheries of the plate members without the use of any wires or other longitudinal locking members.

6 Claims, 6 Drawing Figures

Fig. 1.
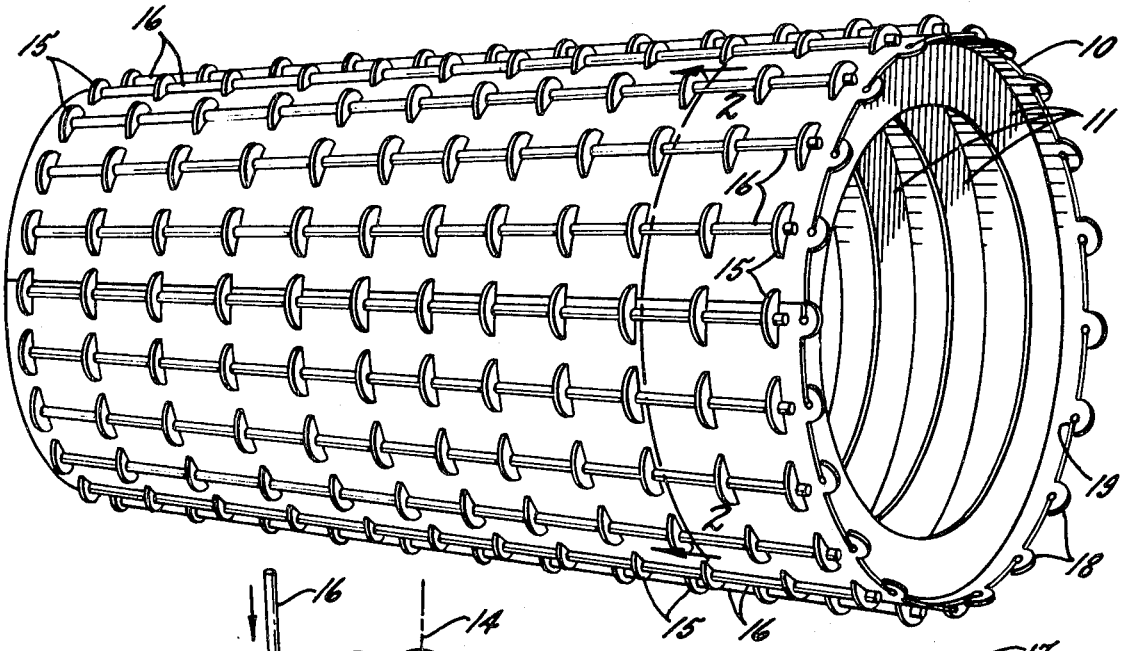
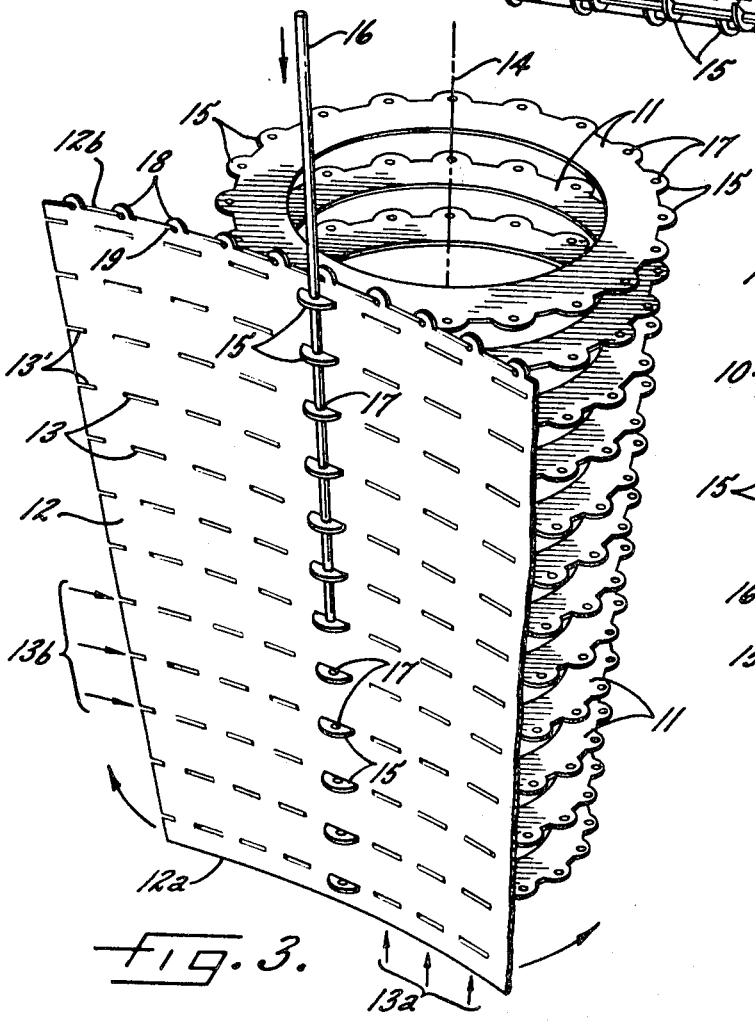
Fig. 3.
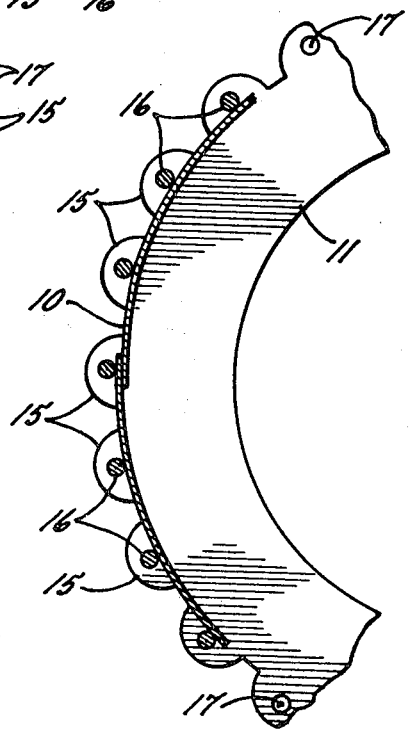
Fig. 2.

Fig. 4.
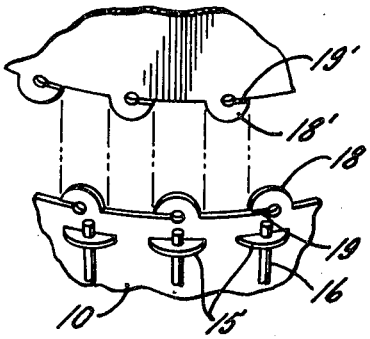
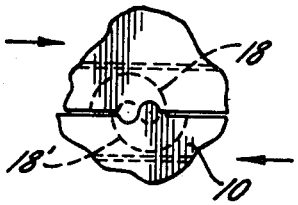
Fig. 5.
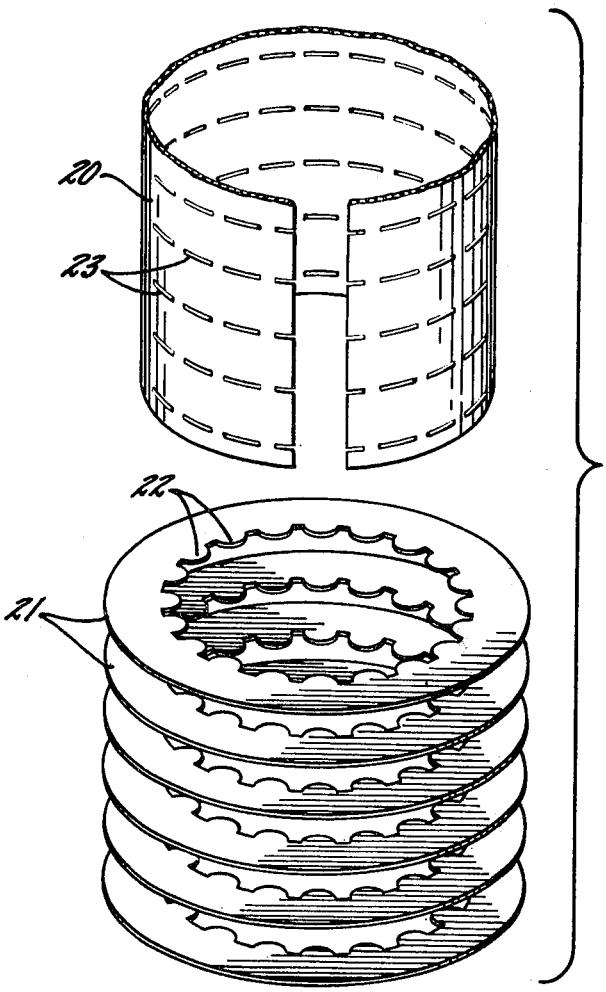
Fig. 6.

CORRUGATED MICROWAVE HORN

This is a division, of application Ser. No. 506,168, filed Sept. 16, 1974, now U.S. Pat. No. 3,914,861.

DESCRIPTION OF THE INVENTION

This invention relates to corrugated microwave horns and the like and, more particularly, to a new construction for such corrugated horns and the like which greatly simplifies their manufacture.

"Corrugated" horns have been known and used as feed horns for microwave antennas for several years. These horns are usually "corrugated" only on the inside surface, i.e., they have a number of transverse ribs on the inside surface of the horn, these ribs being spaced apart by grooves or "slots". The depth of the corrugations represents a sufficient fraction of the wavelength of the transmitted electromagnetic energy to constitute an "impedance surface" which has major effects on the transmission, particularly with respect to propagated and suppressed transmission modes or field patterns. There are normally at least two slots per wavelength along the length of the horn, so the total number of corrugations in any given horn is relatively large.

Heretofore, corrugated microwave horns have generally been fabricated by conventional machining, welding and/or casting techniques. The use of these techniques has made the corrugated horns costly to manufacture and has also made such manufacture a relatively slow process. Furthermore, these conventional methods of fabrication have required the horn and the various parts thereof to have sufficient thickness to allow for the stress of machining and/or for the flow of molten metal during casting. As a result, the final horn contains considerably more metal than is required for the horn to perform its intended function, i.e., the transmission of microwaves. Because of the well known "skin effect" phenomenon, the high frequency electric currents carried by such a horn flow along the surface of the horn, so the horn can be extremely thin and still carry the necessary current. In fact, the thicker metal is not only unnecessary, but also is undesirable because in many cases it introduces greater losses than are incurred with thinner metal and requires the use of stronger and more expensive mounting and supporting structures.

It is, therefore, a primary object of the present invention to provide an improved construction for corrugated microwave horns which permits the use of metal which is substantially thinner than required by other fabrication techniques. A more specific object of the invention is to provide such an improved construction which permits the use of metal only a few thousandths of an inch thick.

A related object of the invention is to provide an improved construction for corrugated microwave horns of the foregoing type which permits the fabrication of horns which are much lighter in weight than corrugated horns made heretofore. In this connection, another related object of the invention is to provide such a construction which requires less expensive mounting and supporting structures because of the lighter weight of the corrugated horn.

It is another object of the invention to provide such an improved construction for corrugated microwave horns which permits the horns to be fabricated in a fraction of the time required to fabricate the same horns by conventional fabricating techniques.

A further object of the invention is to provide such an improved corrugated microwave horn construction which permits the horns to be fabricated using very inexpensive equipment. In this connection, a related object of the invention is to provide such a construction which requires only a minimal capital investment to fabricate the horns, so that it is feasible to fabricate a relatively small number of such horns at any given facility.

Still another object of the invention is to provide such an improved corrugated microwave horn construction which ensures accurate spacing, orientation and positioning of the various parts of the horn without the use of any special fixtures during fabrication of the horn.

A still further object of the invention is to provide such an improved corrugated microwave horn construction which permits relatively long horns to be made at a reasonable cost and a reasonable weight, so that it becomes more feasible to use longer horns to reduce phase error.

Yet another object of the invention is to provide an improved construction for tubular articles other than microwave horns that have a number of corrugations or the like spaced along their axes, such as heat exchanger tubes and the like.

Other objects and advantages of the invention will be apparent from the following detailed description together with the accompanying drawings, in which:

FIG. 1 is a perspective view of a corrugated microwave horn embodying the invention;

FIG. 2 is a section taken along line 2—2 in FIG. 1;

FIG. 3 is a perspective view of the various parts of the horn of FIG. 1 during one of the early stages of fabrication;

FIG. 4 is an exploded perspective view of a fragment of the horn of FIG. 1 in position to be joined to a mating horn section;

FIG. 5 is a fragmentary elevation of the two sections shown in FIG. 4 after being joined together; and FIG. 6 is an exploded perspective view of a modified embodiment of the invention.

While the invention will be described in connection with certain preferred embodiments, it will be understood that it is not intended to limit the invention to those particular embodiments. On the contrary, it is intended to cover all alternatives, modifications and equivalent arrangements as may be included within the spirit and scope of the invention as defined by the appended claims.

Turning now to the drawings and referring first to FIG. 1, there is shown a flared corrugated microwave horn having a frustoconical shell 10 with a multiplicity of parallel transverse ribs or plates 11 spaced at equal longitudinal intervals along the inner surface of the shell 10. These plates 11 are all of equal radial width and lie in planes perpendicular to the axis of the shell 10. A flared microwave horn of the type illustrated is normally used as a "feed" horn for a microwave antenna, such as a parabolic dish-type antenna. Although the horn is commonly referred to as a "feed" horn, it obviously functions as a part of the antenna system in both the sending and receiving modes. Although the invention has been illustrated in a flared horn, it should be understood that not all microwave horns are flared and the invention is equally applicable to both flared and unflared horns.

The criteria for designing corrugated microwave horns for different applications are well known in the art and will not be dwelled upon here. The present invention is not concerned with a horn intended for any specific application or intended to meet any specific performance criteria, but rather is directed to a new construction which is generally applicable to corrugated horns regardless of their particular shape, the number of corrugations, the slot corrugation width, the corrugation depth, etc.

In accordance with one important aspect of the present invention, the horn shell 10 is formed from a thin flat sheet of flexible conductive metal having a multiplicity of spaced slots arranged in longitudinal columns and transverse rows, and the annular plates 11 are formed with a multiplicity of integral tabs spaced around the periphery of each plate with each tab having an aperture therethrough. Then the horn is assembled by fitting one of the tabs on each of the plates through the slots in a selected longitudinal column, inserting a wire through the apertures of those tabs to lock the slotted sheet to the annular plates, rolling the sheet around the peripheries of the plates to fit successive tabs through successive longitudinal columns of slots, and inserting wires through the apertures in successive tabs to lock the sheet to successive portions of the peripheries of the annular plates. Thus, as shown most clearly in FIG. 3, the shell 10 initially comprises a thin flat sheet 12 of flexible conductive metal in the shape of an annular segment so that when it is rolled about an axis 14 equidistant from its non-parallel edges, it forms the desired frustoconical horn. While the sheet 12 is still flat, a multiplicity of slots 13 are formed therethrough in a multiplicity of longitudinal columns 13*a* and parallel transverse rows 13b. The columns and rows of slots 13 are arranged so that when the sheet 12 is rolled into the shape of the frustoconical horn, the slots 13 are arranged in a series of circumferential rows lying in planes which are perpendicular to the axis of the horn and equally spaced around the circumference of the horn. Thus, in the case of the sheet 12 illustrated for forming the frustoconical horn 10, the transverse rows 13*b* lie on arcs having different radii, and both the width of the slots and the transverse spacing between the slots in successive rows gradually increases from the shorter curved edge 12*a* of the sheet 12 toward the longer curved edge 12*b* to maintain the longitudinal alignment of the slots in each of the columns 13*a*.

For the purpose of fastening the annular plates 11 to the sheet 12 in precisely predetermined positions relative to each other and the sheet 12, while at the same time facilitating formation of the sheet 12 into the frustoconical shell 10, each of the plates 11 forms a multiplicity of tabs 15 around its outer periphery. The number of tabs 15 is equal to the number of slots 13 in each transverse row 13*b*, taking into account the fact that one of the slots in each row is formed by the overlapping of two open-ended partial slots 13 formed in the two non-parallel straight edges of the sheet 12. To ensure that each tab 15 can be fully inserted in its corresponding slot 13 so that the sheet 12 butts against the periphery of the corresponding plate 11 in the spaces between the tabs, the transverse dimensions of the slots 13 are made slightly longer than the transverse dimensions of the bases of the tabs 15.

In order to lock the tabbed plates 11 to the slotted sheet 12, while still permitting the sheet 12 to be rolled around the plates 11 to form the desired frustoconical horn, one tab of each plate 11 is first inserted in the mating slot 13 in one of the longitudinal columns 13*a*, as illustrated in FIG. 3. With the tabs 15 all thus inserted in that one longitudinal column of slots, a wire 16 is fitted through the apertures 17 formed in each of the inserted tabs 15, extending along the outer surface of the sheet 12. As can be seen most clearly in FIG. 2, the apertures 17 are positioned so that the innermost edge of the aperture 17 is flush with the outer surface of the sheet 12 when the tab 15 is fully inserted in its slot 13. Also, each of the apertures 17 is dimensioned so that its diameter is only slightly larger than the outside diameter of the wire 16. Consequently, when the wire 16 is fitted through the tabs 15, the adjacent peripheral portions of the plates 11 are held tightly against the inside surface of the sheet 12.

After the first wire 16 is in place, the sheet 12 is gradually rolled around the peripheries of the plates 11 with successive tabs 15 on the plates being fitted into successive longitudinal columns 13*a* of the slots 13 and locked thereto by means of additional wires 16. This operation is repeated until the sheet 12 has been rolled around the entire circumference of the plates 11, at which point the two non-parallel edges of the sheet 12 overlap each other to create a single column of slots meshing with the last set of tabs. Then when the last wire 16 is inserted through the last set of tabs 15, it presses the two overlapping edges of the sheet 12 tightly against the adjacent portions of the plates 11 so that the final horn shell is essentially continuous around its entire circumference, with the two overlapped edge portions being held tightly against one another (see FIG. 2).

It will be appreciated that this construction permits the use of metal of minimum thickness as required by the electrical and mechanical performance criteria for any given microwave horn. Both the horn shell 10 and the plates 11 can be made from metal that is less than 0.01 inch thick, typically 0.005 inch to 0.006 inch, which permits weight reductions on the order of 20 to 1 as compared with similar horns made by conventional techniques. Because of the reduction in the amount of metal in the horn, it is much lighter in weight than conventional horns, permitting considerable savings in mounting and support structures. Moreover, a corrugated horn constructed in accordance with this invention can be fabricated in a fraction of the time required to fabricate comparable horns by conventional fabricating techniques. Using this construction, it becomes feasible to manufacture relatively long horns with a reasonable weight; this is an important advantage because long horns are often desirable for reducing phase error.

To facilitate the locking of the sheet 12 to the multiple plates 11 during the assembling operation, the slotted sheet 12 is preferably made of a resilient material. Then as the sheet is rolled around the peripheries of the plates 11, the resilience of the sheet 12 biases it outwardly against the previously inserted wires 6 so as to increase the frictional forces between the sheet 12, the wires 16 and the tabs 15. These frictional forces tend to hold all the assembled elements tightly in place so that early portions of the assembly do not come apart during later stages of the assembling operation.

If desired, additional tabs may be formed on the ends of the horn shell 10 for joining this horn section to adjacent horn sections, so that a horn of any desired length can be made by simply interconnecting the desired number of sections. Thus, in the illustrative embodiment the wide end of the shell 10 forms a multiplicity of axially extending semi-circular tabs 18 each of which forms a slot 19 extending halfway through the tab in the transverse direction. Thus, if an adjacent horn section has similar axial tabs 18' forming slots 19' (FIG. 4), the slots 19 and 19' may be meshed with each other by overlapping each set of axial tabs 18 and 18' with the end portion of the adjacent horn shell until the two sets of slots are in radial alignment with each other, and then turning the two horn sections relative to each other so that the tabs are brought into axial alignment with each other. In the final assembly, each semi-circular axial tab overlaps the end portion of the adjacent shell along the inside surface of the shell so that the two horn sections are locked together with the tabs either inside or outside the horn. If desired, the locking may be made more permanent by a soldering operation, or by means of a suitable adhesive if desired.

One of the significant advantages of the present invention is that all the parts used to form the corrugated horn are either readily available or easily fabricated by readily available and relatively inexpensive equipment. Thus, the wires 16 may be conventional bronze wire. The plates 11 and the sheet 12 may be formed from conventional spring temper sheet brass by conventional photoetching in the same type of equipment used to form printed circuits, for example. Using this photoetching technique, the slots 13 may be formed in the sheet 12 with extremely narrow dimensions and yet with very precise positioning and repeatability. Similarly, the dimensions of the annular plates 11, which must gradually increase in diameter along the axis of the horn, as well as the shape and dimensions of the tabs 15 and the apertures 17 therein, may also be precisely controlled by the photoetching technique. Consequently, all the necessary parts can be easily formed with a high degree of reliability and repeatability using equipment that requires only a small capital investment, and those parts can then be easily assembled by hand.

Another advantage of the invention is that the starting materials used to form the horn may all be in the form of either wire or flat sheet stock, so that the small amount of metal in the horn can all be used in a form in which it has maximum strength. In general, metal acquires maximum strength after being cold worked such as by rolling or drawing. In this case, the sheet metal used to form the shell 10 and the plates 11 has been rolled and the wires 16 have been drawn. Consequently, not only is the amount of metal in the horn minimized, but also the strength of that metal is maximized.

Yet another advantage of the invention is that the meshing of the tabs 15 with the slots 13, which is necessary to assemble the horn, ensures accurate positioning and orientation of the plates 11 relative to the horn shell 10 without the use of any special fixtures during the fabrication of the horn. This is in contrast to assembly techniques used with machined parts heretofore, in which special jigs or fixtures have been required to obtain proper positioning and alignment of the various parts that are joined together to form the final corrugated horn.

While the construction of this invention is particularly useful in the production of corrugated microwave horns, it can also be used to form other types of corrugated tubular articles which comprise a tubular member with a plurality of transverse plates, fins or other members secured thereto. For example, this construction can be used to form heat exchangers with fins radiating either internally or externally from a tubular conduit carrying a heating or cooling medium. One example of such a structure is illustrated in FIG. 6, in which a slotted tubular member 20 is locked to a series of annular fins 21 having tabs 22 on their inner peripheries rather than their outer peripheries. To assemble the product, the longitudinal edges of the tubular member are simply overlapped to form a tube having a diameter smaller than the innermost diameter of the tabbed fins 21, thereby permitting the tube to be inserted longitudinally through the multiple fins 21. The tube is then released and the tabs 22 are brought into register with circumferential rows of slots 23 in the tube 20 so that the tabs 22 fit through the slots 23. The inherent resilience of the flat sheet that is rolled to form the tubular member 20 biases the tubular member outwardly against the fins 21 in the spaces between the tabs 22 so that it is not even necessary to have any wires passing through the tabs 22. In this case, of course, it is not necessary to have the slots aligned with each other in the longitudinal direction.

If desired, the fins 21 can have any desired shape other than the circular configuration illustrated, such as square plates or elongated strips for example, as long as they have the requisite tabbed openings for receiving and holding a slotted flat sheet rolled to form the tubular member 20. If desired, more than one tubular member 20 can extend through any given fin or plate by simply providing more than one tabbed aperture in the fin.

In the case of a microwave horn, it is usually important to have the plates 11 continuously joined electrically to the horn shell 10 around the entire outer circumference of each plate 11 for improved power handling capabilities, elimination of electrical noise during vibration, and to prevent the formation of undesirable oxide films between the plates and the shell. In other applications, it is equally important to have the tubular shell 10 or the tubular member 20 be fluid tight. In either case, the desired result may be achieved by a simple soldering operation. For example, in the case of the microwave horn, soft solder may be applied over the entire outer surface of the final assembly, using solder in the form of a paste for example, after which the entire assembly is heated so that the solder runs into each of the slots to provide a continuous solder connection between the shell 10 and each plate 11 around the entire circumference of each plate. At the same time, the solder runs along each of the wires 16 so that they also become bonded to the shell 10 and the tabs 15 so that the entire assembly become more rigidly interconnected.

Although the invention has been described with specific reference to the use of continuous wires 16 to lock the tabbed and slotted members together, it will be understood that discontinuous wires or other locking elements could be used if desired. Also, the longitudinal locking member could be in the form of a flat strip or any other desired configuration other than a wire, provided the apertures in the tabs are redesigned accordingly.

I claim as my invention:

1. A corrugated microwave horn comprising the combination of:

a. a thin sheet of conductive metal rolled into the shape of a horn and having a multiplicity of spaced slots formed therethrough, said slots being arranged in a plurality of rows extending around the circumference of the horn and in longitudinal alignment with each other, b. a plurality of thin annular plates of conductive metal disposed within said horn in alignment with said rows of slots, each of said plates forming a multiplicity of integral tabs spaced around the outer periphery of the plate, said tabs extending through the slots in said horn with the portions of the tabs projecting beyond the outer surface of the horn having apertures formed therethrough adjacent said outer horn surface, c. and a multiplicity of wires extending through the apertures in said tabs along the outer surface of the horn.

2. A corrugated microwave horn as set forth in claim 1 which includes an electrically conductive medium joining each of said plates to said horn around the entire circumference thereof.

3. A corrugated microwave horn as set forth in claim 2 wherein said electrically conductive medium is solder.

4. A corrugated microwave horn as set forth in claim 1 wherein said horn and said plates are formed of sheet metal having a thickness of less than about 0.01 inch.

5. A corrugated microwave horn as set forth in claim 1 wherein the sheet of metal that is rolled to form the horn is a resilient sheet.

6. A corrugated microwave horn as set forth in claim 1 wherein said wires are bonded to the outer surface of the horn.

* * * * *